United States Patent [19]

Schramm

[11] 3,933,342

[45] Jan. 20, 1976

[54] ORE PROCESSING FURNACE

[76] Inventor: Arthur G. Schramm, 3113 E. Highland Ave., Phoenix, Ariz. 85016

[22] Filed: Oct. 29, 1974

[21] Appl. No.: 518,575

[52] U.S. Cl. ..... 266/15; 13/8; 266/17; 266/20

[51] Int. Cl.[2] ..... F27B 9/10

[58] Field of Search ..... 266/15, 16, 17, 20; 432/66; 13/8

[56] References Cited

UNITED STATES PATENTS

| | | | |
|---|---|---|---|
| 2,287,476 | 6/1942 | Hodson et al. | 266/17 |
| 2,550,684 | 5/1951 | Fouquet | 266/17 |
| 3,876,189 | 4/1975 | Jackson et al. | 266/17 |

*Primary Examiner*—Roy Lake
*Assistant Examiner*—Paul A. Bell

[57] ABSTRACT

An ore processing furnace particularly adapted for processing ores at generally low temperatures ranging between 600° Fahrenheit and 1200° Fahrenheit: said furnace comprising an ore containing and processing chamber structure surrounded by a fire box and having ore heating tubes extending inwardly from the fire box to a central exhaust gas pipe whereby the ore heating tubes extend through a body of ore in said chamber; vapor collectors disposed above said ore heating tubes and extending upwardly through said chamber structure; vapor collectors above said ore heating tubes direct vapor upwardly through vapor conduits to an upper portion of said furnace in the area of an ore receiver at the upper portion thereof and the vapors are collected in a plenum which also exchanges heat to the ore for preheating it before it passes downwardly into an area around the ore heating tubes and a condenser communicating with the plenum condenses ore vapor to a liquid or a solid condition as may be appropriate.

Variable delivery fuel means is directed to furnish energy to burners in the lower portion of the fire box and the variable delivery air driving means is disposed to deliver air to said air insulating chamber whereby variable delivery of fuel and insulating air as well as variable drive of said augur provides for coordinating controls adapted to coordinate the processing of ore in said chamber structure and heat transferred to said vapor and to said insulating air is used to preheat ore in an upward area of said furnace at the receiver thereof. Additionally, hot gas from said central exhaust pipe heats a heat exchanger which is disposed in an area of an ore receiver at the upper portion of said furnace for exchanging heat to the ore and preheating it before it gravitates downwardly into an area of said ore heating tubes.

17 Claims, 5 Drawing Figures

ORE PROCESSING FURNACE

BACKGROUND OF THE INVENTION

Various furnaces have been devised for low temperature processing of ores, however, many of them have been inefficient due to substantial heat losses and also due to a lack of efficiency in transferring heat from the fire box to the ore as it passes downwardly through the furnace. Accordingly, many prior art or processing furnaces have been inefficient due to improper transfer of heat to the ore and loss of heat from the furnace due to radiation conduction or convection of such heat away from the furnace and away from the ore being processed therein.

SUMMARY OF THE INVENTION

The present invention comprises an ore processing furnace particularly adapted for processing ores such as antimony or the like which require temperatures ranging generally between 600° and 1200° Fahrenheit. The furnace comprises efficient means for heating the ore in the ore containing and processing chamber as well as efficient means for transferring heat of the exhaust and air insulation as well as ore vapors to an upper area of the furnace wherein the heat normally lost from such furnaces is transferred into the ore in a receiver area thereof for preheating the ore preliminary to its passage into an area wherein ore heating tubes are disposed in communication with the fire box of the furnace. The furnace of the invention has a novel fire box which surrounds an ore processing chamber and ore heating tubes extend from the fire box radially inward to a central hot gas exhaust pipe and thus extends through ore in the chamber while vapor collectors are disposed above the heating tubes in a generally horizontal position and these vapor collectors are generally of downwardly directed V-shaped in cross section structure adapted to trap the rising vapors and edges of these collectors are generally overlapped in a superimposed relationship to each other so that rising vapors in the chamber will meet and pass into one or the other of the collectors. These vapor collectors communicate with conduits which extend upwardly to a vapor receiving plenum which has an outlet communicating with a condenser for condensing the ore into a liquid or solid state as desired and which may be appropriate.

The plenum receiving the hot vapor is disposed in an upper area of the furnace near the receiver thereof and is adapted to transfer heat to incoming or downwardly moving ore in an area directly below an opening which extends downwardly in a converging relationship from the ore receiver of the furnace so that heat is efficiently transferred from the vapor receiving plenum to ore in the upper portion of the furnace for preheating the ore before it reaches the area of the ore heating tubes which communicate with the fire box. Additionally, a heat exchange means communicates with the interior and surrounding areas about the hot gas exhaust pipe so that hot gases from the exhaust pipe are transferred outwardly in an area surrounding the central exhaust pipe and into ore in the ore receiver of the furnace above the ore heating tubes thereof so that the exhaust gases from the fire box are used to preheat the ore before it reaches the ore processing temperature afforded by the ore heating tubes which extend from the fire box into the hot gas outlet pipe in a generally horizontal and radial direction. The ore heating tubes are raised in a generally radiating array diverging outwardly from the hot gas outlet pipe to the surrounding fire box area of the furnace. An air insulating chamber around the fire box insulates the fire box from losses and an insulating layer around the insulating air chamber further prevents conductive losses. The air from the air chamber moves upwardly through conduits to an area of the exhaust gas outlet pipe below the aforementioned heat exchanger so that the heat conducted from the fire box to the insulating air is transferred into the area of the hot gas exhaust into the area of the heat exchanger which preheats the ore in the ore receiver of the furnace.

The furnace of the invention comprises rate controlled fuel means adapted to deliver fuel to burners in the lower portions of the fire box at a variable rate. Additionally, an ore removal augur is adapted to remove ore waste from the lower portion of the ore processing chamber structure of the invention and this augur being operable at a variable rate cooperates with the variable fuel delivery means in the fire box and further a variable delivery air supply means is disposed in communication with the insulating air chamber surrounding the fire box so that various rates may be adjusted to efficiently process ore so as to remove an optimum percentage of vaporous elements from the ore as it passes downwardly through the furnace. Additionally, vibrating means is coupled to the ore receiver at the upper part of the furnace in order to assist in the downward gravity flow operation of the crushed ore into intimate relationship with the ore heating tubes of the furnace. The ore heating tubes of the furnace are directed below the vapor collectors and thus heat rising from the tubes also heat the vapor collectors which are disposed such that the ore contacts the upper surface of these vapor collectors and thus any ore which is processed above the tubes will emit vapor which will pass upwardly into the next superimposed vapor collector thereabove.

Accordingly, it is an object of the present invention to provide a very efficient ore processing furnace adapted to operate in a temperature ranging between 600° and 1,200° Fahrenheit and wherein heat carried in the exhaust gases and in the ore vapors as well as insulating air surrounding the fire box is utilized to preheat ore in an upper portion of the furnace before the ore reaches the ore heating tubes in the processing chamber of the furnace.

Another object of the invention is to provide an ore processing furnace particularly adapted for processing ore such as those containing antimony or the like.

Another object of the invention is to provide a novel means for heating ore in a furnace and for collecting desirable vapors therefrom.

Another object of the invention is to provide a novel furnace construction having substantially circular cross section with radiating ore heating tubes extending from a surrounding fire box into a central exhaust gas outlet system and novel collectors disposed over the ore heating tubes for collecting vapors from the ore.

Another object of the invention is to provide an ore heating furnace in which various factors such as heat input or movement rate may be adjusted to obtain optimum results in processing of ore in the furnace.

Another object of the invention is to provide means by which exhaust gas from the furnace as well as insulating air surrounding the fire box thereof and hot vapors processed from the ore all exchange their heat to ore entering the processing chamber whereby the ore is preheated thereby.

Another object of the invention is to provide a very simple efficient and economical ore processing furnace.

Further objects and advantages of the invention may be apparent from the following specification, appended claims and accompanying drawings.

DESCRIPTION OF THE PREFERRED EMBODIMENTS

Figure 1:
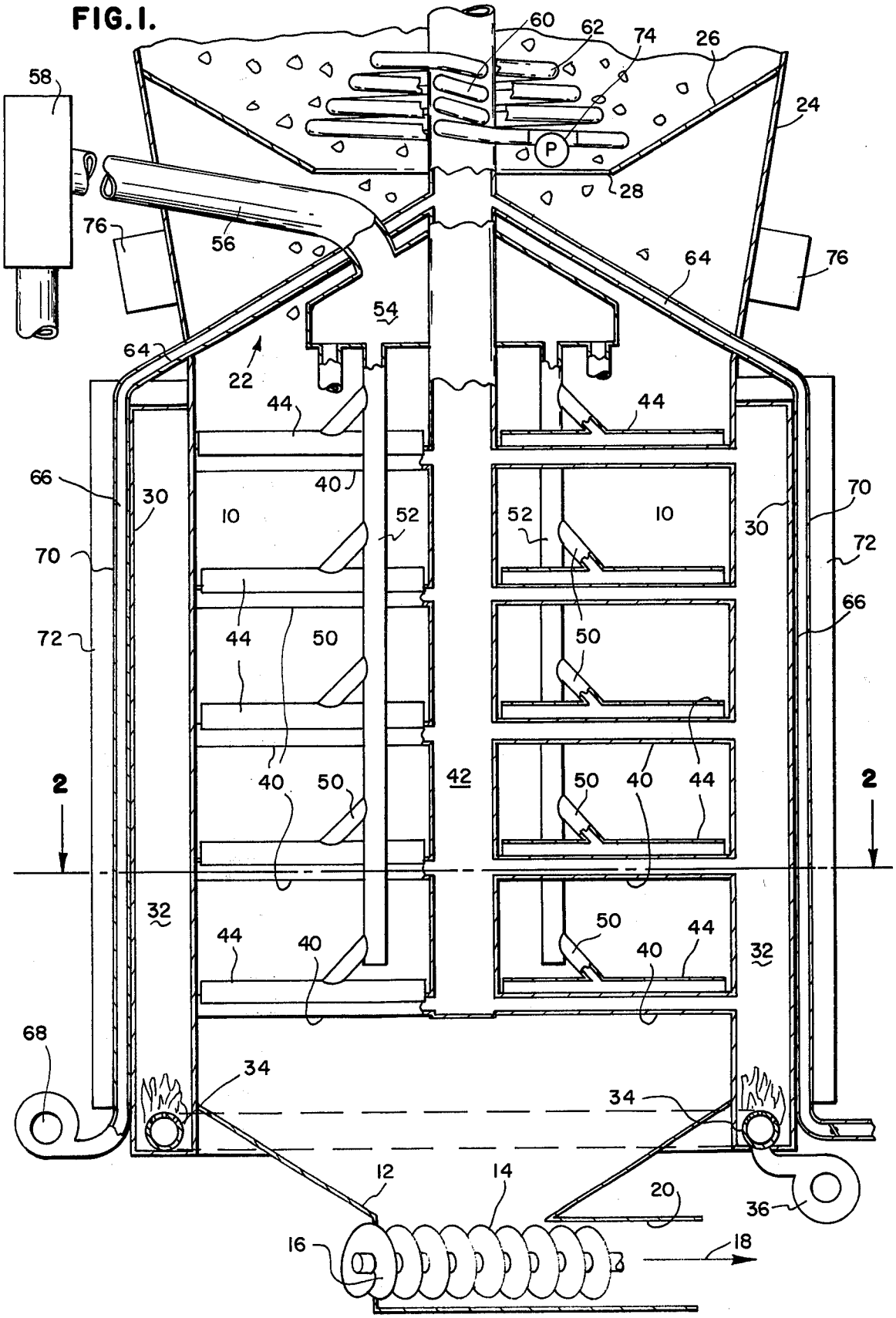
FIG. 1 is a fragmentary vertical sectional view of the ore processing furnace of the invention showing structure further broken away and in section and portions in elevation to amplify and facilitate the disclosure.

As shown in FIG. 1 of the drawings, the furnace is provided with an ore containing and processing chamber structure defined by a generally cylindrical wall member 10 which is preferably made of steel or the like. This chamber structure 10 is provided with a downwardly converging bottom 12 communicating with an outlet 14 thereof in which a helical augur 16 is adapted rotatably to move ore waste such as rock particles or the like in the direction of an arrow 18 through a waste outlet conduit 20.

The ore waste removal augur 16 is preferably driven by variable speed motor for rate control of the flow of waste material in order to also control the compaction inflow of ore particles being processed in the chamber structure 10.

The chamber wall structure 10 is provided with an upper open end portion 22 with which an ore receiver 24 communicates. This ore receiver 24 is composed of a generally downwardly converging fresto-conical structure and this structure is provided with an inwardly directed generally downwardly converging ore feed structure 26 having a central opening 28 therein which feeds ore downwardly into a generally central area of the chamber structure 10.

Surrounding the ore processing chamber wall 10 is a fire box surrounding wall 30 which constitutes a heat retaining wall spaced from the wall structure 10 of the ore processing chamber. The spaced relationship of the wall 30 from the wall 10 provides a fire box area 32 in the lower portion of which burner means 34 is disposed. This means 34 is preferably gas fired and communicates with a variable delivery fuel means 36 which may be a variable air delivery pump carrying a fuel gas mixture so that variable delivery of fuel to the burners 34 may be accomplished.

The burner structure 34 is preferably a generally circular structure adapted to surround the generally circular fire box wall 10.

Figure 2:
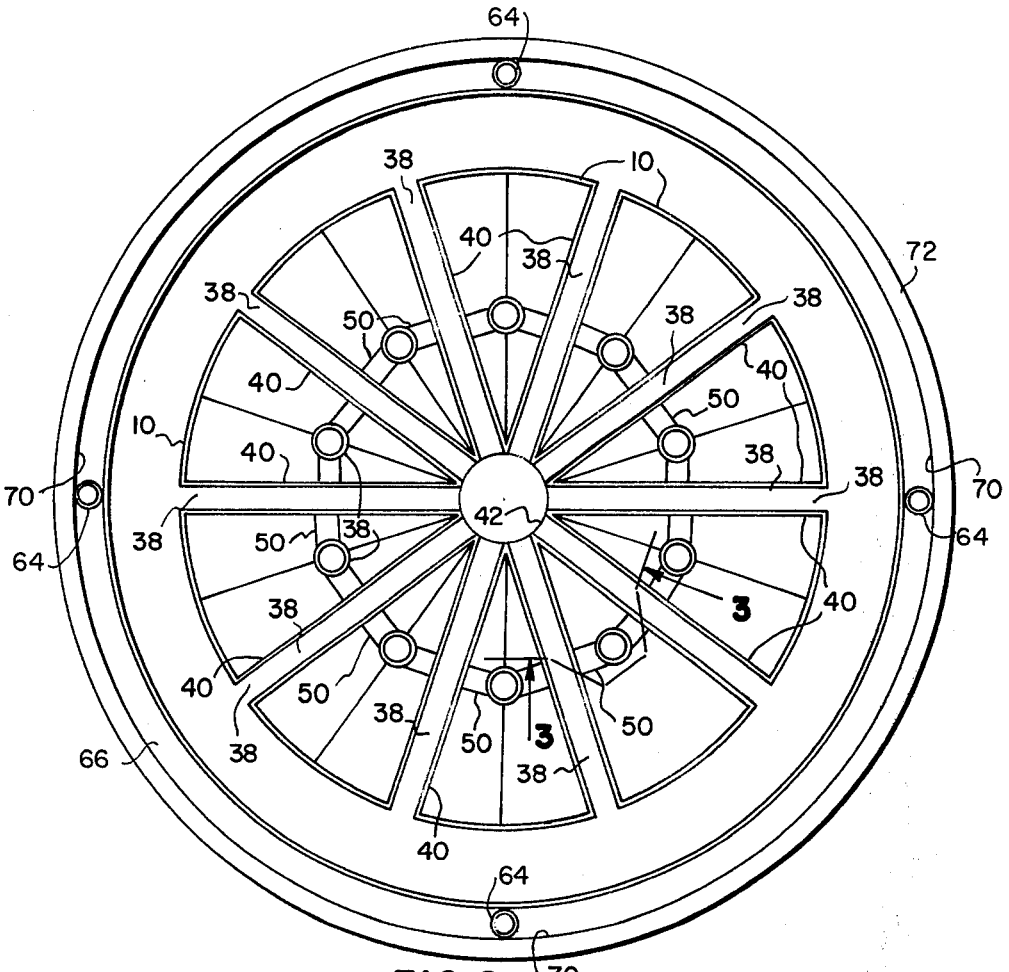
FIG. 2 is a planned sectional view taken from the line 2—2 of FIG. 1.

Communicating with the fire box area 32 through openings 38 in the wall 10 are ore heating tubes 40. These ore heating tubes 40 extend radially inward in a generally horizontal direction and communicate at their inner ends with the interior of the exhaust gas pipe 42 shown best in FIGS. 1 and 2 of the drawings. This pipe 42 is disposed generally centrally in the chamber 10 and extends upwardly through a central area of the ore receiver 24 as shown best in FIG. 1 of the drawings. Thus hot gas from the fire box 32 passes horizontally through the ore heating tubes 40 and directly above these ore heating tubes 40 are vapor collectors 44 which are disposed to receive rising vapors vaporized from the ore in the chamber structure 10.

Figure 3:
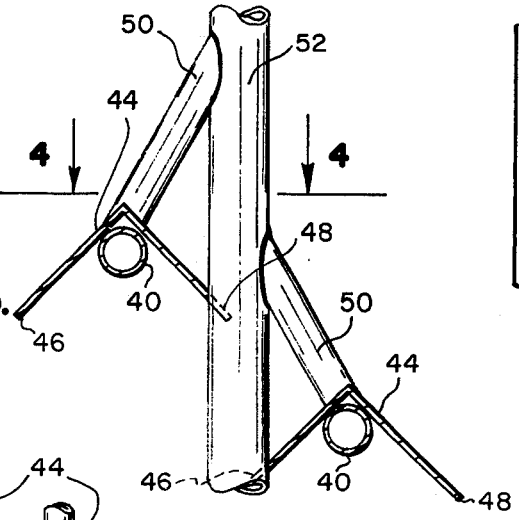
FIG. 3 is an enlarged fragmentary sectional view taken from the line 3—3 of FIG. 2.
Figure 4:
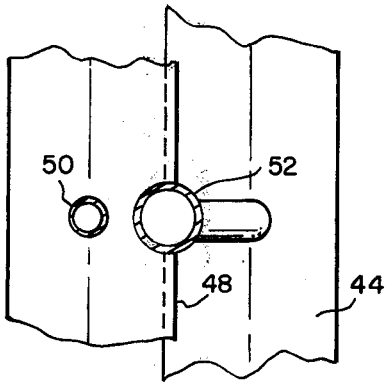
FIG. 4 is a fragmentary planned sectional view taken from the line 4—4 of FIG. 3.
Figure 5:
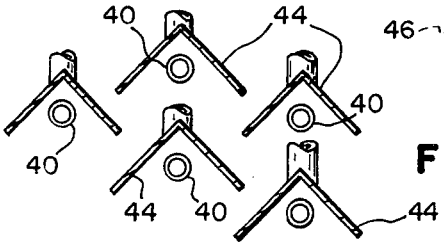
FIG. 5 is a diagramatic view of the staggered relationship of the vapor collectors of the furnace in relation to the disposition of the ore heating tubes therein.

As shown best in FIGS. 3 and 5 of the drawings, the vapor collectors 44 are disposed and staggered and superimposed relationship to each other and each collector 44 is disposed over a respective ore heating tube 40. Opposite edges of superimposed vapor collectors 44 being designated 46 and 48 generally overlap each other as shown in FIGS. 3 and 4 of the drawings so that vapor rising upwardly will enter one or the other of the vapor collectors 44 and pass upwardly through respective branch conduits 50 which enter generally vertical vapor conducting tubes 52 which transfer the vapor upwardly into a vapor receiving plenum 54 having an outlet 56 communicating with a conventional vapor condenser 58 adapted to condense the vapor to either liquid or solid state as may be desired and appropriate to the particular material being condensed.

The vapor plenum 54 is a generally circular structure surrounding the centrally located hot gas exhaust pipe and the plenum 54 is directly below the outlet opening 28 of the downwardly converging receiver structure 26 so as to receive ore thereon and such that heat transfer is made between the vapors entering the plenum 54 and the incoming ore so as to preheat the ore by means of the heat in the vapors entering the plenum 54.

These vapors are antimony vapors in case of antimony ore and may be other vapors depending upon the ores being processed.

Hot gases from the exhaust pipe 42 pass upwardly into communication with heat exchanger coils 60 internally of the exhaust pipe 42 and these coils 60 communicate in a closed circuit relationship with coils 62 outside the exhaust pipe 42 and in the area of the ore entering the receiver 24 so that hot gases from the fire box which pass upwardly through the exhaust pipe 42 after heating the ore by means of the tubes 40 is used to preheat the ore before it passes downwardly into an area of the ore heating tubes 40.

Additionally, the hot gas exhaust pipe 42 receives hot air from tubes 64 which pass upwardly from an insulating air chamber 66 surrounding the outer wall 30 of the fire box 32. The insulating air space 66 being supplied air by variable delivery air moving blower 68 which delivers insulating air into the chamber 66 which is surrounded by a wall structure 70 and a layer of insulation 72. Thus the insulating air chamber 66 conducts air which prevents heat exchange to a substantial degree to the wall 70 and the insulation 72 prevents losses externally of the wall 70. Accordingly, air heated in the air insulation chamber 66 passes upwardly through the tubes 64 and contributes to the heat in the hot gas exhaust pipe 42 which heat is extracted by the heat exchanger coil 60 and transferred to the coil 62 which in turn transfer heat to the ore entering the furnace for preheating it before it reaches the ore heating tubes 40.

A liquid circulating pump 74 is disposed in circuit with the coils 60 and 62 and is adapted to deliver liquid through the coils so that heat will be transferred by the liquid from the coils 60 to the coils 62.

The liquid may be water or any other suitable liquid even liquid metal depending upon the desired temperature range in which exchange is to be made from the heated air and gases passing upwardly through the hot gas exhaust pipe 42.

Vibrators 76 are coupled to the ore receiver 24 and may be used vibrationally to cause particulate or crushed ore to move downward through the ore processing chamber 10 to the augur 16 and these vibrators 76 may also be operated variably to aid in optimum flow relationship to the heat input and the vaporization of materials from the crushed ore as desired.

In operation, the ore enters the receiver above the downwardly converging structure 26 and the ore is gravity fed or vibrated downward through the opening 28 onto the plenum 54 which preheats the ore while the ore is also being preheated by the coils 62 hereinbefore described.

As the vibrators move the ore downward into the chamber 10 it is heated by the heating tubes 40 which receive substantial heat from the fire box 32. The ore surrounding the areas of the tubes 40 as well as the vapor collectors 44 is heated such that material such as antimony or the like is vaporized and this vapor passes upwardly through the ore and into upwardly converging structures of the vapor collectors 44 and thence into the plenum 54 and the condenser 58.

The superimposed overlapping edges 46 and 48 of the vapor collectors 44 provides assurance that the entire cross sectional area of the chamber 10 is covered by vapor collectors so that all the vapor rising will pass into the various vapor collectors as it moves upwardly through the heated ore.

Diagramatically, FIG. 5 discloses the overlapping relationship of the superimposed vapor collectors 44 in relation to the ore heating tubes 40. It will be understood that the vapor collectors 44 are tapered radially and convergingly inward toward the pipe 52 as shown generally in FIG. 4 of the drawings. Thus the construction is adapted in a manner to attain complete coverage of the cross section of the ore processing chamber by the vapor collectors so that all of the rising vapors will be collected and transferred through the conduits 52 to the plenum 54.

It will be appreciated that the heat transfer from the insulating air chambers 66, the vapor plenum 54 and the gases passing upwardly through the hot gas exhaust pipe is all utilized to preheat the ore before it reaches the main processing area of the furnace wherein the ore heating tubes 40 are disposed.

By operating the vibrator 76, the augur 16, the variable fuel delivery means 36 and the variable delivery air supply means 68 provide means by which the functions thermodynamically may be coordinated to attain optimum processing of the ore to obtain the greatest percentage of the ore vapors from the ore as may be economically feasible.

It will be obvious to those skilled in the art that various modifications may be resorted to without departing from the spirit of the invention.

I claim:

1. An ore processing furnace adapted for processing ores such as those containing antimony and which require temperatures ranging generally between 600° Fahrenheit and 1200° Fahrenheit; said furnace comprising: an ore containing and processing chamber structure having a surrounding wall and an upper open end provided with an ore receiver; said chamber structure having a lower partially enclosed end; a power operated means in said lower end adapted to be driven at a controlled rate to move ore waste such as rock particles or the like from said lower end of said chamber structure; a heat retaining wall surrounding said chamber structure and disposed in spaced relation thereto and defining a fire box space adjacent said chamber structure; said surrounding wall of said chamber structure having a plurality of openings extending therethrough; ore heating tubes communicating with said space; a central hot gas exhaust pipe extending upwardly through said chamber structure; said ore heating tubes intercommunicating with said openings and said hot gas exhaust pipe for conducting hot gas through the interior of said chamber structure whereby said ore heating tubes conduct heat to ore in said chamber structure; vapor collectors above said ore heating tubes; vapor conduits communicating with said vapor collectors and extending upwardly through said chamber structure.

2. The invention as defined in claim 1, wherein: an air housing structure having upper and lower ends is provided with a wall surrounding said heat retaining wall and spaced therefrom to provide an insulating air space around said heat retaining wall.

3. The invention as defined in claim 2, wherein: means is provided for delivering air under pressure to said insulating air space near said lower end of said air chamber structure; and conduit means for conducting heated air into an area above said vapor collectors of said ore receiver for preheating ore therein.

4. The invention as defined in claim 1, wherein: said power operated means comprises a rotatable augur.

5. The invention as defined in claim 1, wherein: said central hot gas exhaust pipe also extends through said ore receiver and said heat retaining wall of said air housing structure is provided with insulation material adapted to prevent heat transfer to the atmosphere surrounding said furnace.

6. The invention as defined in claim 1, wherein: said ore receiver is provided with a downwardly converging generally inverted frusto-conical funnel like structure having an opening therein surrounding said hot gas exhaust pipe; a plenum below said opening of said ore receiver; said plenum communicating with said vapor conduits whereby hot vapor in said plenum tends to preheat ore which gravitates from said opening in said ore receiver and said preheating of ore being in an area above said vapor collectors.

7. The invention as defined in claim 1, wherein: heat exchange means is disposed to be heated by hot gases rising in said exhaust pipe; said heat exchange means being disposed to preheat ore surrounding said exhaust pipe and in an area above said vapor collectors.

8. The invention as defined in claim 2, wherein: a layer of insulation is disposed around said air housing structure.

9. The invention as defined in claim 3, wherein: said means for delivering air under pressure is a variable delivery means adapted to vary the flow of air in said insulating air chamber.

10. The invention as defined in claim 1, wherein: said vapor collectors are disposed above said ore heating tubes and are generally roofed shaped structures having apex portions with downwardly diverging structure generally in the form of an inverted V-shaped trough.

11. The invention as defined in claim 10, wherein: adjacent edges of said vapor collectors are superimposed one above the other and are in generally overlapped relationship to each other so that vapors rising in the body of ore around said heating tubes will enter an adjacent collector or the next superimposed collector therabove.

12. The invention as defined in claim 11, wherein: said vapor collectors in their superimposed relationship have generally overlapping edges which are radially tapered divergingly in a direction from said central hot gas exhaust pipe toward the said surrounding wall of said ore containing and processing chamber structure.

13. The invention as defined in claim 1, wherein: fuel burners are disposed in a lower area of said fire box and variable delivery fuel means is disposed for delivery of fuel to said burners for generating hot gas in said fire box.

14. The invention as defined in claim 7, wherein: said heat exchange means is provided with a tubular coil in said hot gas exhaust pipe; said coil having inlet and outlet portions projecting through the wall of said hot gas outlet pipe and having integral external coils disposed radially outward from the periphery of said hot gas exhaust pipe to conduct preheating energy to said ore.

15. The invention as defined in claim 14, wherein: said coils are provided with a heat transfer liquid and pump means for circulating said liquid in said coils.

16. The invention as defined in claim 1, wherein: a condenser is disposed for receiving vapor from said vapor conduits whereby said vapor may be condensed for collecting liquid or solid material vaporized from said ore.

17. The invention as defined in claim 1, wherein: vibrator means is provided for vibrating said ore downwardly into said ore containing and processing chamber structure.

* * * * *